US010443135B1

(12) United States Patent
Aoun

(10) Patent No.: US 10,443,135 B1
(45) Date of Patent: Oct. 15, 2019

(54) NEAR NEUTRAL PH PICKLE ON MULTI-METALS

(71) Applicant: MacDermid Enthone Inc., Waterbury, CT (US)

(72) Inventor: Chalo Aoun, Waterbury, CT (US)

(73) Assignee: MacDermid Enthone Inc., Waterbury, CT (US)

( * ) Notice: Subject to any disclaimer, the term of this patent is extended or adjusted under 35 U.S.C. 154(b) by 0 days.

(21) Appl. No.: 15/977,526

(22) Filed: May 11, 2018

(51) Int. Cl.
*B08B 3/08* (2006.01)
*C23G 1/26* (2006.01)
*C23G 1/00* (2006.01)

(52) U.S. Cl.
CPC ..... *C23G 1/26* (2013.01); *B08B 3/08* (2013.01); *C23G 1/00* (2013.01)

(58) Field of Classification Search
CPC ..... C23G 1/00; C23G 1/26; B08B 3/08
See application file for complete search history.

(56) References Cited

U.S. PATENT DOCUMENTS

| | | | | |
|---|---|---|---|---|
| 4,042,451 | A | 8/1977 | Lash et al. | |
| 4,437,898 | A | 3/1984 | Drosdziok et al. | |
| 4,687,545 | A | 8/1987 | Williams et al. | |
| 4,720,332 | A | 1/1988 | Coffey | |
| 4,978,424 | A | 12/1990 | Matsuda et al. | |
| 5,377,398 | A | 1/1995 | Bessey | |
| 5,668,096 | A * | 9/1997 | Rodzewich | C23F 11/08 252/385 |
| 5,743,968 | A | 4/1998 | Leeker et al. | |
| 5,866,013 | A * | 2/1999 | Kessler | C02F 5/12 210/701 |
| 5,879,465 | A | 3/1999 | McKevitt et al. | |
| 6,407,047 | B1 | 6/2002 | Mehta et al. | |
| 6,500,328 | B1 | 12/2002 | Fortunati et al. | |
| 6,750,128 | B2 | 6/2004 | Kondo et al. | |
| 7,344,602 | B2 | 3/2008 | Varrin et al. | |
| 7,396,417 | B2 | 7/2008 | Fischer et al. | |
| 8,323,416 | B2 | 12/2012 | Bradley et al. | |
| 2005/0209117 | A1* | 9/2005 | Friedrich | C08G 73/0233 510/175 |
| 2011/0309296 | A1 | 12/2011 | Boehme et al. | |

FOREIGN PATENT DOCUMENTS

| | | |
|---|---|---|
| CA | 2276475 | 5/2007 |
| WO | 2016035261 | 3/2016 |
| WO | 2016055758 | 4/2016 |

* cited by examiner

*Primary Examiner* — Sharidan Carrillo
(74) *Attorney, Agent, or Firm* — Carmody Torrance Sandak & Hennessy LLP

(57) ABSTRACT

A near neutral pH pickling composition for the removal of oxides from metallic surfaces, including heat treated steel. The pickling composition comprises a) a water-soluble organic or inorganic nitro compound, wherein a central N atom has an oxidation state of 3+; b) a polarizing agent for the nitro compound, wherein the polarizing agent comprises at least one of a phosphonate and a carboxylate; c) a pH buffer, and d) at least one metal complexing agent. The composition is preferably maintained at a pH between about 4.5 and about 7.5. The near neutral pH pickle composition can be used on various metallic surfaces as well as composite surfaces comprising metallic and non-metallic portions.

23 Claims, 7 Drawing Sheets

NEAR NEUTRAL PH PICKLE ON MULTI-METALS

FIELD OF THE INVENTION

The present invention relates generally to a composition for removing metallic oxides from a surface and a method of using the same.

BACKGROUND OF THE INVENTION

Removing metallic oxides from metallic surfaces, otherwise known as pickling, is necessary prior to coating a metal, such as steel, magnesium and magnesium alloys, aluminum and aluminum alloys, zinc and zinc alloys, copper and copper alloys, etc., with any kind of finish, including, for example, electroplating, electroless plating, immersion plating, paint or conversion coating.

Historically, strong acids have been used as pickling agents, including hydrochloric acid, sulfuric acid, nitric acid and phosphoric acid, with a typical pH in the range of about 0.5 to 3.0. Hydrochloric acid and nitric acid yield the best pickled surface but are corrosive to the surrounding equipment and installation. Sulfuric acid and phosphoric acid are not volatile, but their ferrous salts are not as soluble as ferrous chloride and nitrates, and the resulting pickled surface may be rather blemished, which can affect the coating appearance.

Among all metallic oxides, including rust, heat treated scale on steel is the most challenging for removal. Iron oxides formed during heat treatment, including FeO, $Fe_2O_3$ and $Fe_3O_4$ (magnetite), have different solubilities in acids and are layered. FeO, which is the most soluble, constitutes the first layer next to the base metal, and magnetite, which is the least soluble, constitutes the outer layer. Typically, heat affected areas on steel are cracked due to cooling after welding or annealing. The pickling acids work by infiltrating the upper layer through the cracks, quickly dissolving the bottom layer FeO by protonation.

The base metal, Fe(s) is oxidized by $H^+$ that is reduced to $H_{2(g)}$. As a result, small electrolytic cells are created where the exposed steel, Fe, is the anode, the acid is the electrolyte and the upper layer, magnetite $Fe_3O_4$ is the cathode. The nascent $H_{2(g)}$ reduces the magnetite into ferrous ions, that are soluble according to the following equation:

$$Fe_3O_4+H_{2(g)}+6H^+43Fe^{+++}4H_2O \quad (1)$$

Magnetite is dissolved by a redox reaction at a slower rate than the other oxides. It is also magnetic and difficult to shed. Depending on furnace conditions and cycles, the magnetite layer can be thick and tightly uniform and adherent, which can create acid-resistant scale that requires mechanical scale cracking such as shot blasting or roll bending to loosen the scale prior to acid pickling, as described, for example in U.S. Pat. No. 5,743,968 to Leeker et al. and U.S. Pat. No. 5,879,465 to McKevitt et al., the subject matter of each of which is herein incorporated by reference in its entirety. The addition of fluoride to the acid pickling composition has been found to help crack the scale.

If the magnetite layer is uneven, longer immersion times can be required for removal of the magnetite layer. This is problematic because over-pickling can form spots and smut (especially with sulfuric acid), compromising the coating appearance. Long immersion times in acid can also create pitting, where the acid is trapped, leading to delayed blisters under the coating or simply unacceptable appearance. Finally, the $H_{2(g)}$ produced by reaction between acid and Fe(s), adsorbs onto, and penetrates into the steel surface, creating hydrogen embrittlement and causing mechanical failure in the field especially with hardened steel. Pertinent industry specifications limit immersion times in acid baths to a maximum of 10 minutes to avoid hydrogen embrittlement on hardened steel from the pickling step.

Mechanical descaling can be used but is expensive and cannot clean internal surfaces of tubular steel. Media blasting and vibratory finishing are time consuming and costly, although they still are widely used to remove heat treated scale, although they may provide insufficient cleaning of tubular parts and recessed surfaces. Pickling in strong acids is problematic in cast iron because of pores in the cast iron that can trap acids. Equally challenging are amphoteric metals such as zinc and aluminum, which have an oxide layer that should be removed before coating. However, the base metal may be severely attacked in acidic or alkaline solutions.

Concerns from pickling in hydrochloric and nitric acids have driven the industry towards the use of non-fuming acids, weak organic acids and neutral pickles. Because protonation of oxides, by $H^+$ from acids is not enough and a redox reaction is needed, many oxidizer-containing processes have been created to oxidize the base metal iron, copper, tin and zinc, in order to remove superficial scale. These oxidizers, such as nitric acid, hydrogen peroxide, permanganate, persulfate and nitro compounds, are combined with acids, $H^+$, or complexing agents that dissolve metallic oxides. A corrosion inhibitor is added, to prevent rapid atmospheric oxidation at the exit of the pickling solution. Nitric acid and hydrogen peroxide, in particular, foul the rinses quickly with ferric ions and foster flash rusting of the surface in a matter of seconds. These combinations have served the metal industry under different functions: including pickling, as described, for example, in U.S. Pat. No. 6,500,328 to Fortunati et al., descaling, as described, for example, in U.S. Pat. No. 5,377,398 to Bessey, polishing, as described, for example, in U.S. Pat. No. 6,750,128 to Kondo et al., and stripping steel and other metals as described, for example, in U.S. Pat. No. 4,687,545 to Williams et al. and U.S. Pat. No. 4,720,332 to Coffey, the subject matter of each of which is herein incorporated by reference in its entirety.

When the oxidizer is m-nitrobenzene sulfonic acid, or one of its salts, and is combined with organic phosphonates, the processes are either acidic, as described, for example, in U.S. Pat. No. 6,407,047 to Mehta et al., or alkaline (i.e., pH of about 6-14) as described, for example, in U.S. Pat. No. 4,042,451 to Lash, the subject matter of each of which are herein incorporated by reference in its entirety. These oxidizers can be used as metal strippers. However they tend to leave a dark adherent film on the surface, requiring subsequent cleaning and pickling.

When the pH is neutral, and the purpose is descaling steel as described, for example, in U.S. Pat. No. 8,323,416 to Bradley, the subject matter of which is herein incorporated by reference in its entirety, the chemicals used may be completely different from those described in the current invention. For example, U.S. Pat. No. 4,437,898 to Drosdziok, the subject matter of which is herein incorporated by reference in its entirety, describes a passivation process that imparts corrosion inhibition to steel surfaces. This is a weakly alkaline process with a pH between 7.5-10.5, with organic phosphonates but does not contain an oxidizer, let alone a nitro compound, that is capable of removing heat treated scale.

U.S. Pat. No. 7,344,602 to Varrin et al., the subject matter of which is herein incorporated by reference in its entirety, describes a magnetite scale removal process with a pH neutral chemical solution containing complexing agents to soften the scale assisted with a hydro-mechanical cleaning to completely remove the scale. U.S. Pat. No. 7,396,417 to Fischer et al., the subject matter of which is herein incorporated by reference in its entirety, describes an aqueous pickling solution with carboxylic acids that operates at a pH between 2.5-4.0 but does not contain nitro compounds nor phosphonates.

None of the known prior art processes describe an aqueous pickling process that operates at a near neutral pH, provides an improved scale removal mechanism, improves corrosion inhibition and that has a mild attack of substrate.

There also remains a need in the art for an improved pickling composition that is capable of removing metallic oxides, including magnetite and other problematic metallic oxides in an efficient manner and that can operate at a near neutral pH and at ambient temperature.

SUMMARY OF THE INVENTION

It is an object of the present invention to provide an aqueous pickling composition that is capable of operating at a near neutral pH.

It is another object of the present invention to provide an improved aqueous pickling composition that is capable of operating at ambient temperature.

It is still another object of the present invention to provide an aqueous pickling composition that is capable of removing problematic metallic oxides from surfaces in an efficient manner.

It is still another object of the present invention to provide an aqueous pickling composition that is capable of treating metallic surfaces and composite surfaces comprising both metallic and non-metallic portions.

It is still another object of the present invention to provide an aqueous pickling composition that provides improved corrosion inhibition.

To that end, in one embodiment, the present invention relates generally to a near neutral pH pickle solution comprising:

A) a water-soluble, organic or inorganic nitro compound, wherein a central N atom has an oxidation state of +3;

B) a polarizing agent for the nitro compound, wherein the polarizing agent comprises at least one of a phosphonate and a carboxylate;

C) a pH buffer; and

D) at least one metal complexing agent.

In another embodiment, the present invention also relates generally to a method of pickling a surface to remove metallic oxides thereon, wherein the method comprises the steps of:

A) contacting the c surface with a near neutral pH pickle composition comprising:

i) a water-soluble, organic or inorganic nitro compounds, wherein a central N atom has an oxidation state of +3;

ii) a polarizing agent for the nitro compound, wherein the polarizing agent comprises at least one of a phosphonate and a carboxylate;

iii) a pH buffer; and iv) at least one metal complexing agent; and

B) rinsing the surface to remove metallic oxides from the surface.

BRIEF DESCRIPTION OF THE FIGURES

For a fuller understanding of the invention, reference is made to the following description taken in connection with the accompanying figures, in which.

DETAILED DESCRIPTION OF THE PREFERRED EMBODIMENTS

Figure 1:
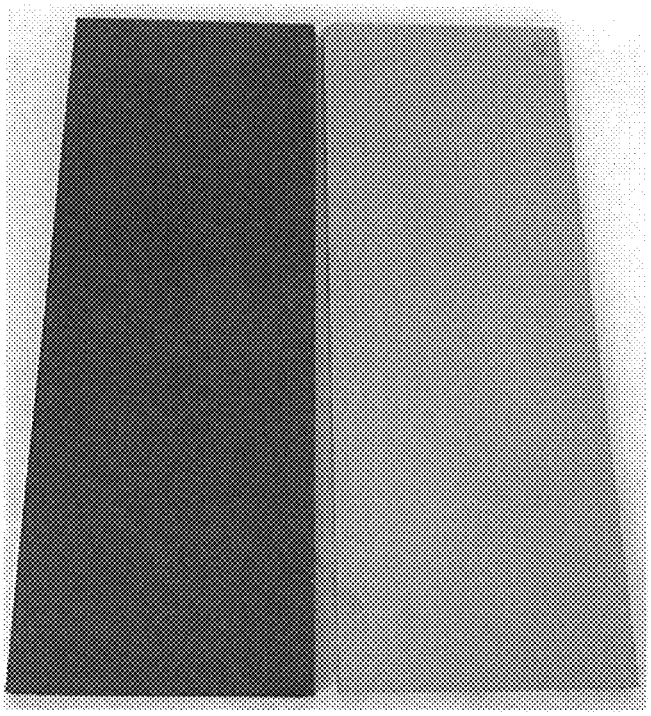
FIG. 1 depicts a photograph of a coupon with heavy magnetite, before and after treatment with the composition as set forth in Example 4, Test 5.

The present invention is directed to a near neutral pH aqueous pickle composition and a method of using the same to prepare surfaces for subsequent treatment thereon.

As used herein by the term a "near neutral pH" what is meant is a pH in the range of about 4.5 to about 7.5.

As used herein, "a," "an," and "the" refer to both singular and plural referents unless the context clearly dictates otherwise.

As used herein, the term "about" refers to a measurable value such as a parameter, an amount, a temporal duration, and the like and is meant to include variations of +/−15% or less, preferably variations of +/−10% or less, more preferably variations of +/−5% or less, even more preferably variations of +/−1% or less, and still more preferably variations of +/−0.1% or less of and from the particularly recited value, in so far as such variations are appropriate to perform in the invention described herein. Furthermore, it is also to be understood that the value to which the modifier "about" refers is itself specifically disclosed herein.

As used herein, spatially relative terms, such as "beneath", "below", "lower", "above", "upper", "front", "back", and the like, are used for ease of description to describe one element or feature's relationship to another element(s) or feature(s). It is further understood that the terms "front" and "back" are not intended to be limiting and are intended to be interchangeable where appropriate.

As used herein, the terms "comprises" and/or "comprising," specify the presence of stated features, integers, steps, operations, elements, and/or components, but do not preclude the presence or addition of one or more other features, integers, steps, operations, elements, components, and/or groups thereof.

In one preferred embodiment, the present invention is directed to a near neutral pH pickle solution comprising:

A) a water-soluble, organic or inorganic nitro compound, wherein a central N atom has an oxidation state of +3;

B) a polarizing agent for the nitro compound, wherein the polarizing agent comprises at least one of a phosphonate and a carboxylate;

C) a pH buffer; and

D) at least one metal complexing agent.

The near neutral pH pickle compositions described herein readily react with steel at ambient temperature without gassing, and complex $Fe^{2+}$ and $Fe^{3+}$ ions, but have no effect on magnetite. The pickle compositions work on heat-treated steel by infiltrating the magnetite layer through cracks and oxidizing iron of the base metal. The near neutral pH pickle compositions provide a good result when treating amphoteric metals such as zinc, aluminum and magnesium. Other metallic and metallic alloy substrates can also be beneficially treated in the manner described herein, including copper and copper alloys. Other applications include pickling composite materials containing several metals or metal with wood, plastic or others as shown, for example, in FIGS. 9 and 10.

The beneficial consequences are short term rust prevention upon storage and inconsequential solution entrapment in recesses, and parts with difficult configuration. This is ideal for installations with long transfer times between pickling steel and applying a coating. The scale removal mechanism can be exploited to exfoliate any other heat related scale such as manganese/iron, silicates and chromium, manganese oxides; or simply the black smut from insoluble metallic salts from hydrogen sulfates and phosphates and or their hydrogenated salts. It is ideal in media free vibratory where the friction of the parts scratches the magnetite layer allowing the solution to reach the base metal and shed off insoluble scale, plus cleaning recessed surfaces with no pitting, no flash rusting.

The water-soluble organic or inorganic nitro compound preferably comprises at least one inorganic or organic nitro compound (aliphatic or aromatic) where N has an oxidation state of 3+.

The nitro group $NO_2^-$ is the oxidant that removes iron. In a preferred embodiment, the nitro group comes from nitrite ions of an inorganic salt, or from a nitro organic compound, which may be aliphatic or aromatic. These nitro compounds should be safe to use, non-explosive when in contact with metal oxides, and water soluble at a near neutral pH.

Nitrites are known to be antioxidant and corrosion inhibitor to steel. Because, they are simply strong electron withdrawing, they block the electron transfer in the corrosion's electrochemical cells that form on steel surfaces exposed to a humid atmosphere.

In one embodiment, the inorganic nitrite group comprises a compound selected from the group consisting of sodium nitrite, potassium nitrite, calcium nitrite, cobalt potassium nitrite, any water-soluble salt of nitrous acid, and combinations of one or more of the foregoing.

It has also been found that amines slow down the removal rate. Therefore, nitro compounds with an amine functional group are preferably avoided and are generally not suitable for use in compositions of the invention. Suitable nitro organic compounds include, but are not limited to, 2-nitro-1 butanol, 2-nitro-2-ethyl-1,3-propanediol, 2-nitro-2-methyl-1-propanol, 5-bromo-5-nitro-1,3-dioxane, tris (hydroxymethyl) nitromethane, 1-nitropropane, 2-nitropropane, 2-bromo-2-nitropropane-1,3-diol, 3-nitrobenzenesulfonic acid, sodium salt, 5-nitrobenzene-1,3-dicarboxylic acid, hydrolysable nitrophenyl esters, other nitrobenzoic acid derivatives that can be dissolved in water and combinations of one or more of the foregoing.

The polarizing agent for the nitro compound preferably comprises at least one inorganic or organic water soluble electron rich oxyanion. This polarizing agent is preferably present in the pickle composition in a specific Molar ratio to the nitro group.

In one preferred embodiment the polarizing agent comprises an organic phosphonate. Examples of suitable phosphonates include salts of inorganic or organophosphonic acids or diphosphonic acids derivatives, which can be adjusted to the desired pH in accordance with the processes described herein. In one preferred embodiment, it was found that organophosphates are preferred because they are easier to use and have shown the most polarizing effect on the nitro aromatic group, leading to the highest iron removal rate. However, the culmination of this interaction is the precipitation of phosphonates with sodium m-nitrobenzene sulfonates, by esterification, at high concentrations (1M) and pH (>5.3), Thus, the iron removal rate dropped to 0.

The near neutral pH pickle compositions described herein were found to work at a slightly lower pH and concentration than the precipitation threshold, thus exploiting to the maximum the steric interaction of the two groups. Organophosphonates have an added value when it comes to corrosion inhibition and metal complexing. However most of the organophosphates have amine radicals that can slow down iron removal rate, especially if there is more than one amine on the C backbone or if the amines are branched.

Examples of suitable phosphonates for use in compositions of the invention include, but are not limited to, sodium phosphonate, sodium poly (isopropenylphosphonate), as 2-ethylhexyl 2-ethylhexylphosphonate, octane phosphonic acid, sodium poly(isopropenylphosphonate), tetrasodium editronate, sodium amino tri(methylene phosphonic acid), benzenephosphonic acid, 1-hydroxyethylidene-1,1-diphosphonic acid, cocoamino-di-methylene phosphonic acid, diamino tetramethyl phosphonic acid, pentasodium diethylene triamine pentamethylene phosphonate, aminotrimethylene phosphonic acid, disodium azacycloheptane diphosphonate, and combinations of one or more of the foregoing.

Figure 6:
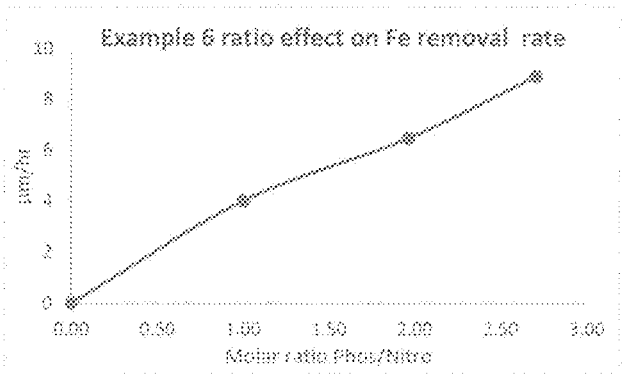
FIG. 6 depicts a graph showing the ratio effect of phosphonate to nitrite using the composition of Example 6 on iron removal rate.

In addition, phosphonates can violently react with inorganic nitrites if the molar ratio of phosphonate to nitrite is low. Therefore, the choice of phosphonate is contingent on the choice of the nitro compound, buffers and other complexing agents to create a coherent system. In a preferred embodiment, the phosphonate is an organophosphonate. In addition, the molar ratio of the phosphonate to the nitro group has a wide range between about 1:1 to 10:1, more preferably between about 1:1 to about 5:1, most preferably at about 2:1 to about 3:1. The molar ratio has a profound effect on iron removal rate as illustrated in Example 6 and as shown in FIG. 6.

Electron rich oxyanions are also necessary in this process to further polarize $NO_2^-$ and make it reactive. Many groups have been tested and have been shown to have a variable effect on the reaction. Preferred oxyanions have more than a steric function on the nitro group and have the additional capacity to serve as buffers or metal complexing agents. This places the carboxylates as top choices for the compositions of the present invention because they have electron-rich oxygen containing ions, are water soluble and are salts of weak acids with $pK_a$ at the foot of the pH range, thus also functioning as the ideal buffers. The preferred oxyanions include, but are not limited to, acetates, citrates, succinates, ascorbates, lactates, gluconates, glucoheptonates, glycolates, salicylates, and combinations of one or more of the foregoing. Less important oxyanions of this group include phosphates and borates, which can also be used in the practice of the invention, although they are not preferred.

When used in conjunction with the nitro group and in absence of organophosphonates, a much higher molar ratio of carboxylate to nitro group is required to initiate the reaction. For example, an acetate/inorganic nitrite Molar ratio is in the range of about 5-20, more preferably in the range of about 10-15 and an acetate/nitro aromatic Molar ratio is in the range of about 2-10, preferably in the range of about 2-3.

Although some of this invention's formulas keep working at pH 7 and in some embodiments, the composition may be maintained at a pH within the range of about 4.5 to about 7.5, is generally preferred to use a buffer to maintain the composition at a pH within the range of about 4.9 to about 6.0, more preferably within a range of about 5 to about 5.5. The reaction consumes H+ and the pH tends to rise. Thus, the stronger the buffer, the longer the reaction lasts. The strength of the buffer should be adjusted to take the reaction to completion. A preferred buffer strength is in the range of about 0.3 to about 1M.

The buffers sustain the reaction and stabilize the nitro group. Inorganic nitrites as described herein cannot be used in acidic solutions, violently reacting to evolve nitrous fumes, even at a pH of 4. At higher pH, their removal rate on steel is nil. Aromatic nitro compounds are much more stable. The sodium salt of m-nitrobenzene sulfonic acid is acid and base stable. However, at a pH lower than about 4.5, it gives an adherent black oxide film that is difficult to dissolve. For example, a black film formed at pH 3 solution showed 26.63 wt. % oxygen on the surface. At a high pH, no surface oxidation was observed, but there was no removal rate either.

In most applications, the near neutral pH pickle composition of this invention is required to work at ambient temperature. When used in industrial installations to pickle heat treated steel prior to coating, the temperature can be instrumental in boosting iron removal rate and may be maintained at a temperature within a range of about 70 to about 180° F., preferably within a range of about 120 to about 140° F. The tradeoff is in degradation of the composition. While higher temperatures are more active, they degrade the solution faster. Ambient temperatures slow the removal rate by half compared to high temperature, but the solution will last longer.

The above recited components of the composition can translate into two or three chemicals, in a given formula of this invention because one chemical product can assume more than one function. For example, a carboxylate may function as both a buffer and as an iron complexor. The stereochemistry and partial charge on the nitro group and the oxyanion paired with it, as well as the concentrations, molar ratio and pH, have a profound effect on the rate of the reaction, measured here by iron removal rate. Other benefits include improved corrosion resistance and blemish/pit-free surface.

Any of the compositions described herein can be manufactured into a gel or paste for touch up applications. This can be accomplished, for example, by adding a chemically inert gellant or a thickener that is also easy to rinse off. These gellants or thickeners include, but are not limited to, silica, magnesium aluminum silicates, Fuller's earth, xanthan gum, acrylic/acrylate polymers and polyvinylpyrrolidone polymers.

In another embodiment, the present invention also relates generally to a method for pickling a surface to remove metallic oxides thereon, wherein the method comprises the steps of:

A) contacting the c surface with a near neutral pH pickle composition comprising:

i) a water-soluble, organic or inorganic nitro compounds, wherein a central N atom has an oxidation state of +3;

ii) a polarizing agent for the nitro compound, wherein the polarizing agent comprises at least one of a phosphonate and a carboxylate;

iii) a pH buffer, and iv) at least one metal complexing agent; and

B) rinsing the surface to remove metallic oxides from the surface.

In one embodiment, the step of contacting the surface with the near neutral pH pickle composition is performed by immersing the surface in the near neutral pH pickle composition for a period of time. This period of time is typically between about 3 minutes and about 24 hours, more preferably between about 10 and about 30 minutes.

As described herein, in one embodiment, the near neutral pH pickle composition is maintained at a temperature between about 70 to about 180° F., more preferably at a temperature between about 120 to about 140° F. during the time period that the surface is contacted with the near neutral pH pickle composition. In another preferred embodiment, the near neutral pH pickle composition is maintained at room temperature during the time period that the surface is contacted with the near neutral pH pickle composition.

The present invention describes compositions that are capable of achieving an iron removal rate superior to those of strong acid pickles; that are non-aggressive on a variety of materials, and that provides a one-step pickle/corrosion inhibitor that is environmentally friendly and can be used in the field for touch up applications and one stage immersion. The synergy between the various reagents can be adjusted through selective ingredients, concentrations and operating temperatures. to reach a removal rate of 20 μm/hr on steel, as illustrated in Example 7 below.

The near neutral pH pickle composition can be used at low concentration, temperature and time to de-oxidize amphoteric metals such as zinc and aluminum. In this embodiment, the near neutral pH pickle composition comprises between about 0.1-0.5 M of the nitro compound, between about 0.2-0.5 M of the polarizing agent, 1-2 M of the pH buffer, and between about 0.2M and about 1M of the at least one metal complexing agent. An example of an exemplary composition for deoxidizing amphoteric metals comprises 0.25 M nitro compound; 0.5 M polarizing agent; 1 M buffer and 0.6 M complexing agent. The contacting temperature is within the range of about 70° F. and about 100° F. and the contacting time is about 1 minute and about to 1 hour.

The near neutral pH pickle composition can also be used at higher concentrations/temperatures to tackle welding and heat treated scale on steel. In this embodiment, the near neutral pH pickle composition comprises between about 0.1-0.5 M of the nitro compound, between about 0.1-0.5 M of the polarizing agent, 0.1-1M of the pH buffer, and between about 0.1 M and about 0.5 M of the at least one metal complexing agent. An example of an exemplary composition for deoxidizing amphoteric metals comprises 0.1 M of the nitro; 0.2 M polarizing; 0.2M Buffer; 0.3 M complexing agent. The contacting temperature is within the range of about 120° F. and about 140° F. and the contacting time is about 20 minutes and about 40 minutes.

Figure 7:
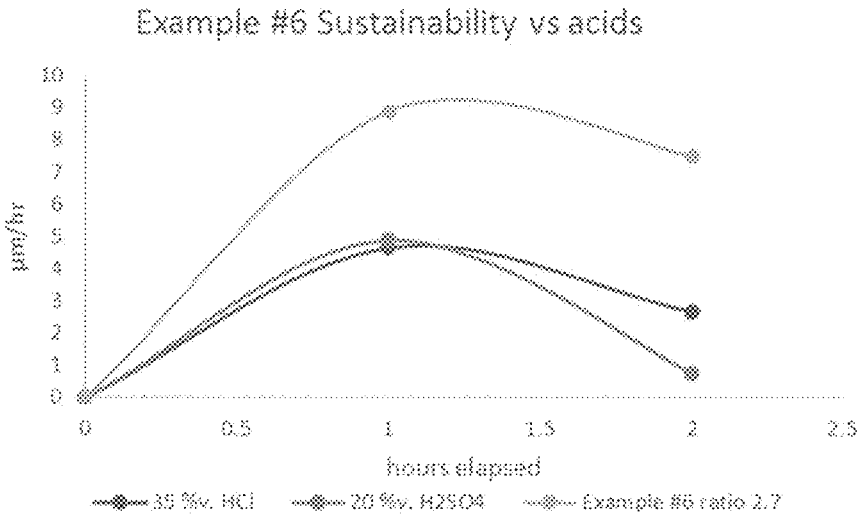
FIG. 7 depicts a graph showing the sustainability versus acids using the composition of Example 6.

Any removal rate ≤1 μm/hr is considered nil; ≤5 μm/hr is acceptable and comparable to acids for light rust removal and non-ferrous metals pickles; ≥7 μm/hr is considered good and superior to strong acids pickles as illustrated in FIG. 7. It is noted that the focus of this description is on iron removal rate and cannot be extrapolated to other metals. For example, zinc removal rate (as shown in Examples 1 and 2) is strongly dependent on pH and is in complete discord with iron removal rate when measured in tandem.

None of the above functional groups can achieve any iron removal rate alone as illustrated in Example 3 A combination of two components could achieve a low removal rate.

Only when all four functional groups are present, in the right ratios, that the reaction takes off, self-sustains, exceeds Fe removal rate of strong acids and yields a silvery steel surface, as shown in Examples 5, 6 and 7 below. Iron removal rate is one of the criteria used to explain the exfoliation process. Removing heat treated scale is the most powerful expression of this invention but there are other less important capacities that do not require a redox reaction such as corrosion inhibition and dissolution of ferrous/ferric compounds by chelation.

The near neutral pH pickle compositions of the present invention may be used for:

1) removal of rust, which is a loose and porous ferric oxide. As described herein a gelled composition may be very useful here in touch up applications 2) removal of insoluble ferrous/l ferric salts that form a black adherent smut in acid pickles like sulfuric acid, phosphoric acid and their hydrogenated compounds 3) removal of blemishes and oxides from nonferrous metals such as zinc and copper.

These functions, corrosion inhibition and metal chelation, can be stretched beyond the narrow pH range dictated for iron oxidation. For example, weak formulas of this invention could be used as corrosion inhibitor at pH 12. At pH 8-9, the formulas can be used to clean metallic surfaces from oxides and blemishes.

When any formulation of this invention was mixed with all components but the nitro group, the surface was smutty and had residual oxygen on the surface. Only when $NO_2$ containing compounds were added back in did that surface became silvery, showing 0% Oxygen by EDS.

Without complexing agents, the reaction slows down as iron oxides, formed on the surface, are not removed to allow the steel, as elemental Fe, to react again. Synergy between the components is important but the nitro group is the driving force. The concentration range and the pH operating ranges are different for inorganic nitrite and nitro organic compound. The nitro aromatic compounds are heat and pH stable, and more reactive with Fe in this process, than inorganic nitrites.

At high concentrations, 0.5-1M, nitro aromatic might jellify with 0.7-1M organophosphonates if blended at pH≥5.3. However, high concentrations are not needed, nitro aromatic compounds are very efficient at low concentrations 0.03-0.5 M and the Fe removal rate remains high for wider pH range 4.9-7.6. To the contrary, inorganic nitrites do not jellify at high concentrations, they emit nitrogen oxides gas if the ratio of the oxyanion is low; they need a higher threshold to operate 0.1-0.8 M and they have a narrower operating pH range 4.9-6. In both cases, high concentrations of nitro groups should be avoided.

The invention will now be discussed in relation to the following non-limiting examples. In all the examples, a heat-treated steel coupon with heavy magnetite was immersed in or otherwise contacted with the near neutral pH pickle composition described in the example.

EXAMPLES

Example 1

Sodium Acetate=2M
Acetic acid=0.42 M
Sodium nitrite=0.27 M
pH=5.58, 75° F.
Molar ratio Acetate/Nitrite 9:1
Wait 1 hr after mixing After mixing, a heat-treated steel coupon was immersed in the composition of example 1. The iron and zinc removal rates were as follows:

Fe removal rate: 5.8 μm/hr
Zn removal rate: 1 μm/hr

Although Example 1 does not demonstrate the best removal rate and sustainability, the acetate solution with sodium nitrite gives the best insight on the interaction with the nitro group because of its simplicity. Sodium nitrite is stable in a pristine solution and does not breakdown into nitrate, unless the solution is spent (which occurs at a pH>7.5 with high soluble Fe and strong air agitation). Thus, it can be seen that the oxidation of steel is initiated by $NO_2^-$ not by $NO_3^-$.

Figures 2A, 2B:
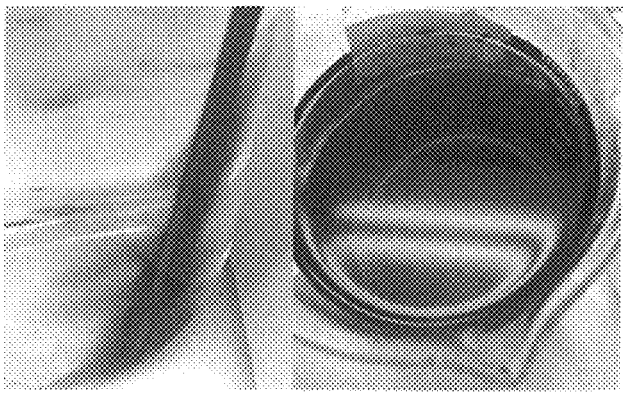
FIG. 2A shows the reaction between clean steel and the composition of Example 1, five minutes after start.
FIG. 2B shows that the red color remains stable for days without any precipitation.

As soon the reaction starts, iron is oxidized, and a red brown coloration appears on the steel surface and spreads in the solution as shown in FIGS. 2A and 2B. FIG. 2A shows the reaction between clean steel and the composition of Example 1, five minutes after start. A red color appears at the steel surface due to the formation of a soluble nitro ferrous complex. FIGS. 2A and 2B show that the red color remains stable for days without any precipitation.

This can be explained by the formation of a ferrous complex of nitrogen monoxide $FeNO(H_2O)_5^{2+}$, typical to dilute nitrous acid aqueous solutions. The red color is stable for weeks but disappears when a stronger iron complexing agent is added. There is no clear documentation of the reaction pathway, but it is believed that there is an interaction between acetates, or other negatively charged oxyanions, with the strongly electron-withdrawing nitro group, that increases the polarity of the nitro group to a point where the resonance[8] in $NO_2^-$ would result in a partial charge of $\delta^-$ on one of the two O (−1), similar to that of hydrogen peroxide and capable of oxidizing Fe (2).

(2)

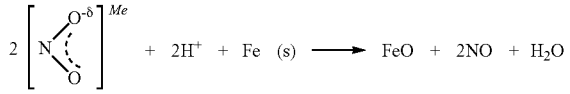

NO, nitrogen monoxide, complexes the ions form as $FeNO(H_2O)_5^{2+}$, additional NO could absorb $O_{2(g)}$ from the air and turn into nitrate; the pH increases as $H^+$ is consumed, this is why the strength of the buffers is key. The reaction does not happen unless the molar ratio of acetate ions to nitrite ions is at least 8:1, and 1-2 hours mixing of the two ingredients is completed before starting the reaction on steel. Below this ratio, no reaction with Fe and dangerous emissions of nitrogen oxides. At a pH range in the range 5-6, the nitrite is not stable, while at a pH above 6 it is not as reactive.

Elemental surface analysis was performed on steel pickled in this process, rinsed in DI water and dried with a soft tissue. Three weeks after processing, it showed 0% wt. oxygen on the surface.

Another feature of pickling with this process is the uniform steel surface, free of blemishes and pitting. This is likely because the reaction (2) does not produce $H_{2(g)}$. responsible for pitting and hydrogen embrittlement, nor $O_{2(g)}$ that causes pitting and flash rusting in nitric and peroxide pickles. Therefore, the immersion times can be extended enough to dislodge all the insoluble magnetite embedded in the surface. This reaction cannot be sustained and completed unless ferrous/ferric complexing agents are present to solubilize the oxides. Depending on the concentrations of the iron complexors and buffer, the solution can keep working until soluble iron reaches 15 g/L, which typically occurs when one of the ingredients is depleted before the others. For example, 15 g/l Fe in Example 7 means 1 liter of solution can remove 20 μm from 1 $ft^2$ steel surface without replenishment. That could translate to 1 μm from 20 $ft^2$ or 4 μm from 5 $ft^2$. As Fe builds up, pH increases and the removal rate slows down. Regeneration of the solution with a mix of all four constituents in the correct ratio, corrects the pH and restores the removal rate. Usually, after 3 turnovers (3 additions equal to the Make-up concentration), regeneration does not help accelerating removal rate, the solution should be disposed of.

Example 2

Figure 5:
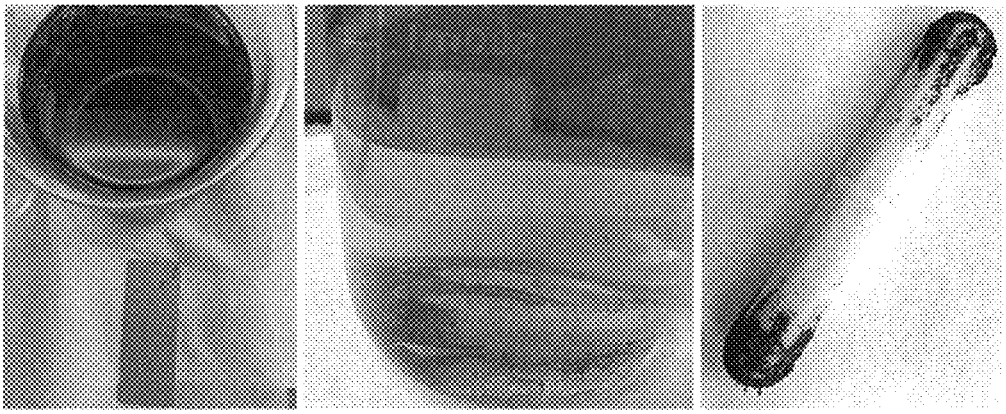
FIG. 5 illustrates a close up on solution color and turbidity of the composition of test 5 of Example 4.

Sodium Acetate=2M
Acetic acid=1.48 M
Sodium nitrite=0.24 M
pH=5.08, 75° F.
Molar ratio Acetate/Nitrite 14.5:1
Wait 1 hr after mixing
Fe removal rate: 5 μm/hr
Zn removal rate: 90 μm/hr Example 3: (FIG. 5)

Figure 3:
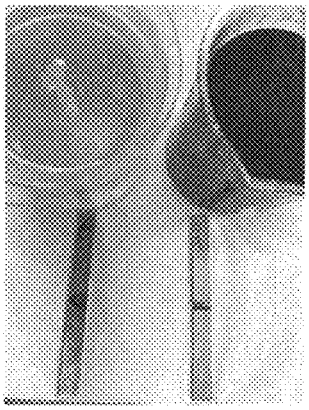
FIG. 3 illustrates a control sample and a test sample prepared in accordance with Example 3.

Control: 0.44 M of m-nitrobenzene sulfonic acid, Na salt, pH adjusted to 5.3 with 1 N. sulfuric acid. Fe removal rate 0.2 μm/hr, steel surface stained Test:
Sodium Acetate=1 M
Acetic acid=0.27 M
Sodium m-nitrobenzenesulfonate=0.44 M
pH=5.3, 75° F.
Molar ratio Acetate/Nitrobenzenesulfonate=3:1
Fe removal rate: 5 μm/hr The acetate reaction with aromatic nitro compounds as shown in Example 3 has the same reaction pattern as in Example 1. The solution turns red brown, the iron removal rate increases dramatically, and the steel surface is silvery clean and impervious to short-term atmospheric corrosion as shown in FIG. 3. However, the m-nitrobenzene sulfonic acid Na salt of Example 3 is much more pH stable than sodium nitrite of Example 1 and requires a lower molar ratio 3:1 (acetate/nitro) to start. FIG. 3 illustrates a control sample and a test sample prepared in accordance with Example 3.

Example 4

Example 4 was undertaken to demonstrate that the individual components do not work alone. It is noted that removal rates from the most used acids on clean cold rolled steel in the 1$^{st}$ hour of reaction are: 4.66 m/hr for 35% by vol. HCl and 4.9 μm/hr of 20% by vol. $H_2SO_4$.

| Test | Aqueous solution | Sodium nitrite | Amino tri (methylene phosphonic acid) | pH | Fe Removal rate μm/hr at 23° C./appearance of the surface |
|---|---|---|---|---|---|
| 1 | DI water | 0 | 0.2M | 5.4 | 0.3 μm/hr tarnished |
| 2 | DI water | 0.43M | 0 | 5.11 | 0.24 μm/hr tarnished |
| 3 | Acetate buffer pH 5.4 1M acetate/0.25M acetic acid | 0.43M | 0 | 5.4 | 1.73 μm/hr tarnished, solution is red |
| 4 | Citrate buffer pH 5.5 0.6M/0.125M citric acid | 0.43M | 0 | 5.5 | 2.2 μm/hr; tarnished |
| 5 | DI water | 0.43M | 0.2M | 5.3 | 5.27 μm/hr; silvery |

Figure 4:
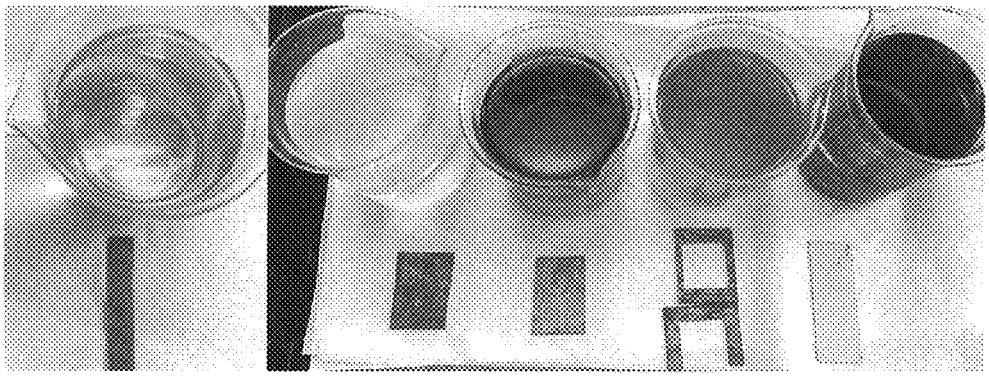
FIG. 4 illustrates the results of tests 1, 2, 3, 4, and 5 after 1 hour of reaction on heat-treated steel coupons with heavy scale.

FIG. 4 illustrates the results of tests 1, 2, 3, 4, and 5 after 1 hour of reaction on heat-treated steel coupons with heavy scale.

FIG. 1 illustrates a heat-treated steel coupon with heavy magnetite before and after treatment with the composition of test 5 of Example 4. As illustrated in FIG. 1 the surface comes out silvery clean and does not tarnish by atmospheric exposure for months.

Unlike in acid pickling solutions, the pickle composition described herein does not dissolve the magnetite by a redox reaction, instead it removes it as debris that is magnetic and can be collected on a magnet as shown in FIG. 5. The reaction rate in this study was measured on clean pickled cold rolled steel, to rule out the weight of magnetite debris that shed. FIG. 5 illustrates a close up on solution color and turbidity of the composition of test 5 of Example 4. A magnet was used to capture the turbidity in the beaker and clear the solution. Once the magnet is removed magnetite debris than fell off the heat-treated coupon is visible on the magnet.

Example 5

Sodium acetate=0.52 M
Acetic acid=0.2 M
Sodium nitrite=0.7 M

1-Hydroxythylidene-1,1-Diphosphonic acid Na salt=0.4M
pH 5.6
Ratio acetate & phosphonate/nitrite=2:1
Fe removal rate=14.6 μm/hr Example 6

1-Hydroxythylidene-1,1-Diphosphonic acid Na salt=0.47 M
Sodium nitrite=0.348 M
Sodium citrate=0.38 M
Citric acid=0.08 M
pH 5.4
Ratio phosphonate/nitrite=2.7:1
Fe removal rate=8.9 μm/hr In this example, the ratio of phosphonate to nitrite was brought up gradually to the final value 2.7. FIG. 6 shows the increase of Fe removal rate as the ratio was increased.

FIG. 7 provides a graph in which after 69 hours, the total amount of scale removed from the surface (total m) using 35 vol. % HCl was 65 μm, the total amount of scale removed from the surface using 20 vol. % $H_2SO_4$ was 96.6 μm, and the total amount of scale removed using the solution of Example 6 was 233 μm. Thus, it can be seen that the removal rate achieved by the composition of Example 6 exceeded that of a strong acid pickle.

In contrast, nitrates, where the oxidation state of N is +5, do not show this removal rate nor the silvery surface when combined with phosphonates and carboxylates.

Example 7

1-Hydroxyethylidene-1,1-Diphosphonic Acid=0.1 M
Sodium gluconate=0.1 M
Sodium citrate=0.1M
Sodium m-nitrobenzenesulfonate=0.06M
Sodium hydroxide to bring the pH to 5.4
Ratio phosphonate/nitrite=1.7:1
Fe removal rate: 4.7 μm/hr at 75° F.; 12.3 μm/hr at 120° F.; 17.5 μm/hr at 140° F.

Figure 8:
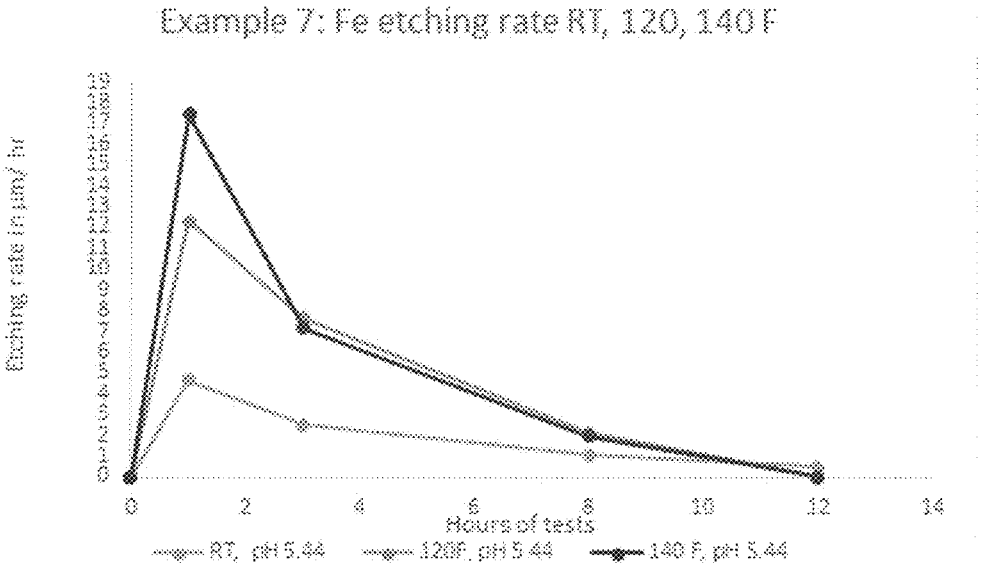
FIG. 8 depicts a graph showing the effect of temperature on iron removal rate using the composition of Example 7.

Organophosphonates show a higher iron removal rate than acetate at lower molar ratio to inorganic nitrite and aromatic nitro compounds. There is a definite synergy between m-nitrobenzene sulfonate and phosphonate especially that the solution can be heated without risk. With the right ratios, buffers, complexing agents, concentrations and temperatures, the steel removal rates of these pickles can reach 20 μm/hour. FIG. 8 shows the effect of temperature on iron removal rate. As shown in FIG. 8, the etch removal rate may be higher than that of commonly used acids such as 35 vol. % HCl and 20 vol. % $H_2SO_4$.

Figure 9:
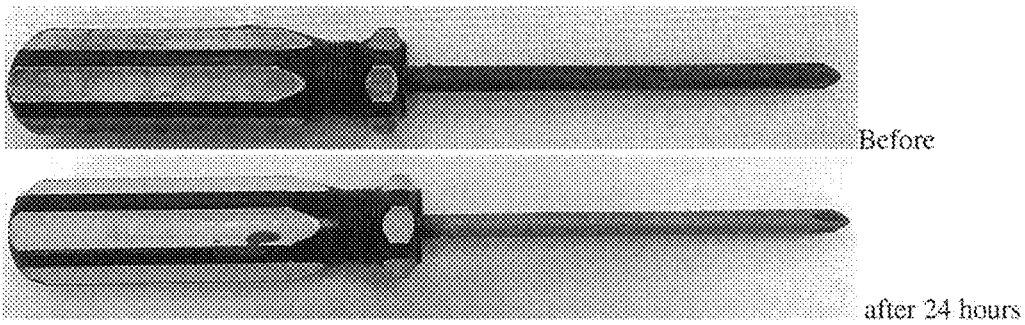
FIG. 9 depicts a photograph showing a screwdriver both before and after immersion in a solution in accordance with Example 7.

FIG. 9 shows a screwdriver having both metallic and non-metallic portions that was immersed in the composition of Example 7 at room temperature for 24 hours. As seen in FIG. 9, the plastic portion remained intact and surface oxides were removed from the metallic portion and the plastic portion.

Figure 10:
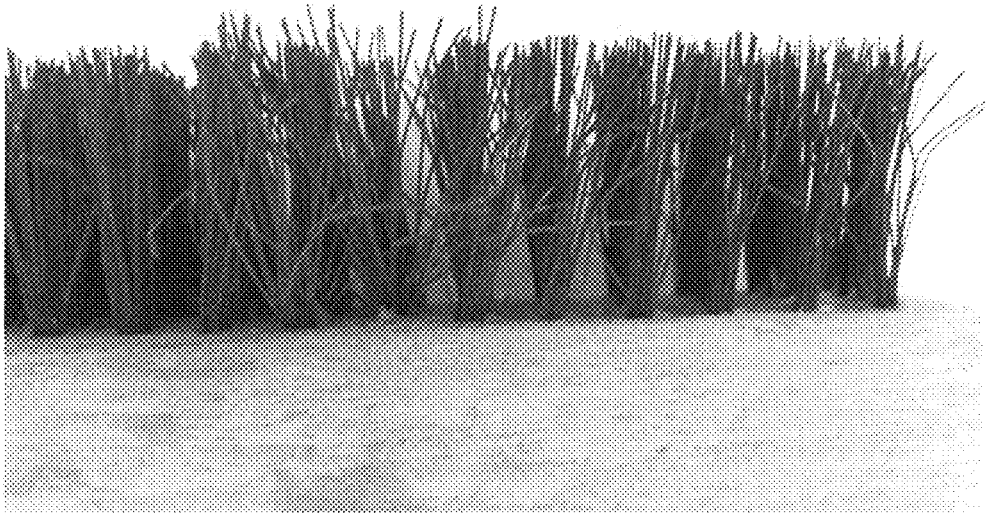
FIG. 10 depicts a photograph of rusted steel brush with the left side untreated and the right side after being immersed in a near neutral pH pickle solution in accordance with the present invention.

FIG. 10 shows a rusted steel brush with a wooden base, in which the right side was immersed in the near neutral pH pickle composition of Example 7, rinsed, and dried and the left side remained untreated. As seen in FIG. 10, the rust oxides were removed from the surface of the rusted steel brush as well as from the wooden base.

Example 8

6 wt. % fumed silica was added to the composition of Example 7. The solution jellified and could be spread on a metallic surface and wiped off. This composition can also be used to remove light rust by simply application followed by a quick water rinse.

In the process described herein, nitro compounds alone, whether inorganic or organic, were observed to have negligible removal rate on steel at near neutral pHs. Once mixed with oxyanions such as phosphonates and carboxylates, in specific ratios, the removal rate increases by several orders of magnitude as shown in Examples 3 and 4 and the removal rates can exceed those of strong acids as illustrated in FIG. 7 and as shown in Examples 5 and 6.

Figure 11:
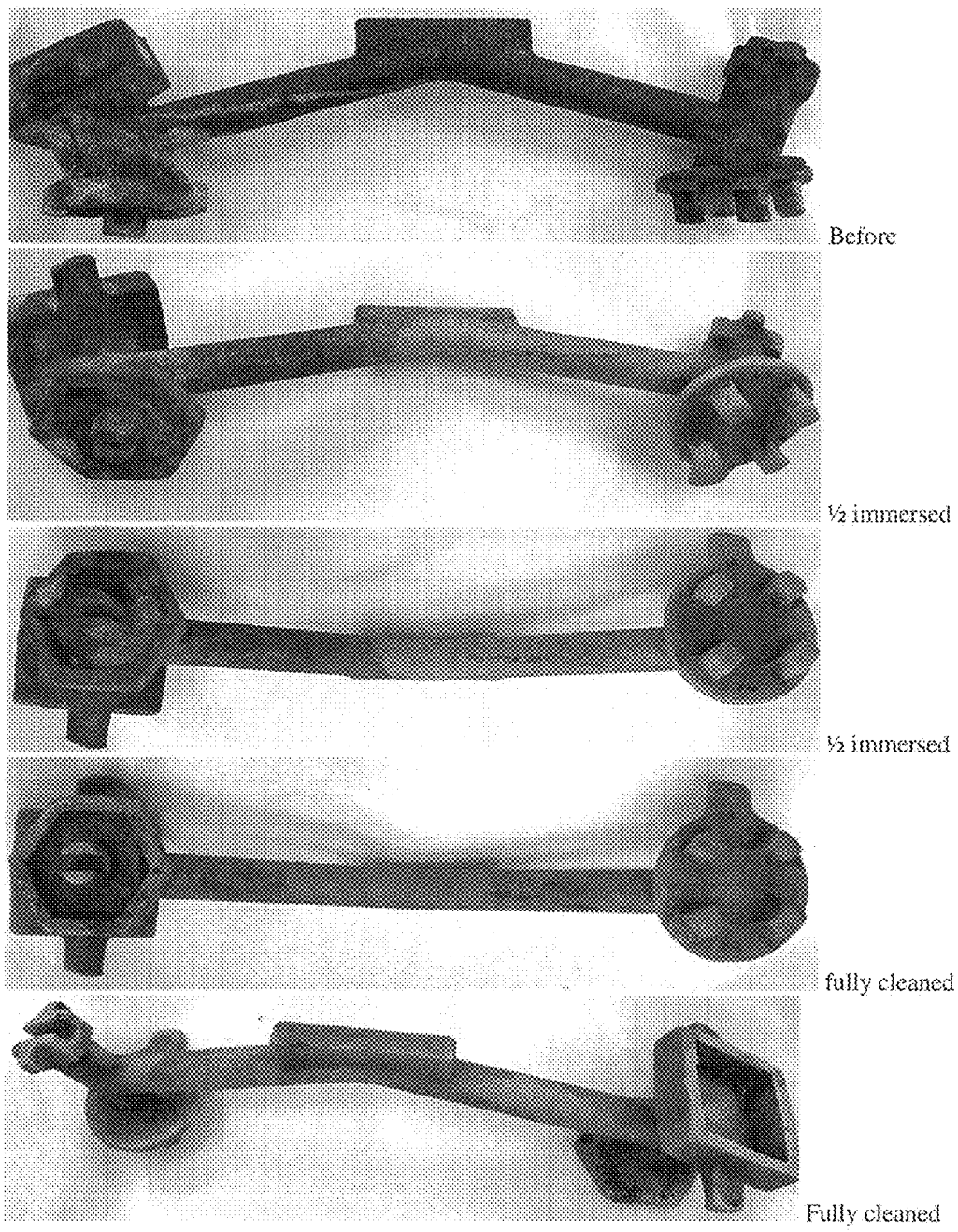
FIG. 11 depicts views of steel tools cleaning in a near neutral pH pickle solution in accordance with the present invention.
Figure 12:
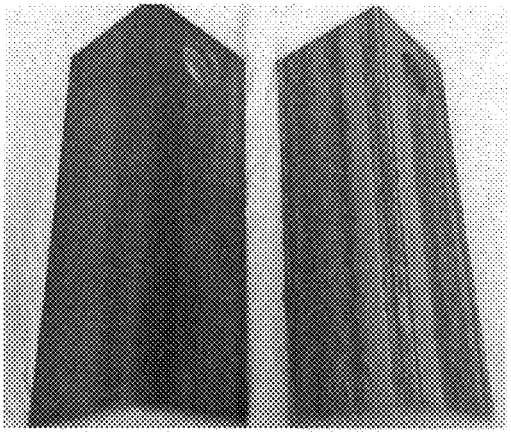
FIG. 12 depicts a photograph of a rusted carbon steel part immersed in a near neutral pH pickle solution in accordance with the present invention, immediately and after two days.
Figure 13:
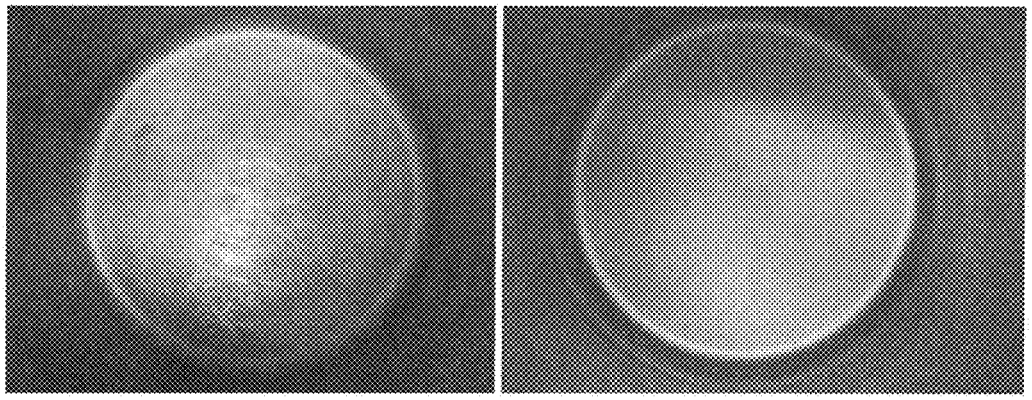
FIG. 13 illustrates a stainless steel container before cleaning and immediately after soaking in a near neutral pH composition in accordance with the present invention.
Figure 14:
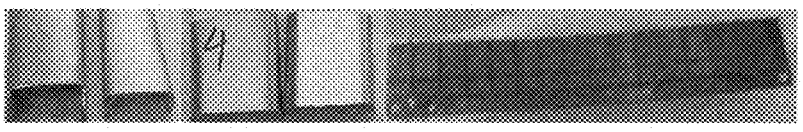
FIG. 14 illustrates zinc, aluminum and copper parts before and after immersion in a near neutral pH composition in accordance with the present invention.

Unlike acid pickling compositions of the prior art, the near neutral pH pickling compositions in accordance with the present invention can be safely used for long hours immersion times, on rusted tools and other commonly used metal objects then quickly rinsed and dried off as illustrated in FIGS. 11 and 12. FIG. 11 illustrates steel tools cleaned in a near neutral pH pickle composition in accordance with the present invention by immersion. FIG. 12 illustrates a rusted carbon steel part prior to immersion and then after immersion in a near neutral pH pickle composition in accordance with the present in invention. The photograph was taken after 2 days and shows no rust re-appearance from the pores. FIG. 13 illustrates a stainless steel container before cleaning and immediately after soaking in a near neutral pH composition in accordance with the present invention. FIG. 14 illustrates zinc, aluminum and copper parts before and after immersion in a near neutral pH composition in accordance with the present invention.

In contrast, none of the prior art compositions describe the removal of heat treated scale at a near neutral pH using a combination of nitro compounds, phosphonates and carboxylates and that is capable of imparting short-term corrosion protection in one step. Nor do the prior art compositions allow for unrestricted immersion times without pitting, tarnishing, and/or $H_2$ embrittlement.

Finally, it should also be understood that the following claims are intended to cover all of the generic and specific features of the invention described herein and all statements of the scope of the invention that as a matter of language might fall there between.

What is claimed is:

1. A method for pickling a surface to remove metallic oxides thereon, wherein the method comprises the steps of:

a) contacting the surface with a near neutral pH pickle composition comprising:
   i) a water-soluble, organic or inorganic nitro compound, wherein a central N atom has an oxidation state of +3;
   ii) a polarizing agent for the nitro compound, wherein the polarizing agent comprises at least one of a phosphonate and a carboxylate;
   iii) a pH buffer; and
   iv) at least one metal complexing agent; and
b) rinsing the surface to remove metallic oxides from the surface.

2. The method according to claim 1, wherein the surface is a metallic surface selected from the group consisting of steel, magnesium, magnesium alloy, aluminum, aluminum alloy, zinc, zinc alloy, copper, copper alloy, and combinations of one or more of the foregoing.

3. The method according to claim 1, wherein the surface is a composite surface comprising a metallic surface and a non-metallic surface.

4. The method according to claim 1, wherein the water-soluble nitro compound comprises a nitro organic compound selected from the group consisting of 2-nitro-1 butanol, 2-nitro-2-ethyl-1,3-propanediol, 2-nitro-2-methyl-1-propanol, 5-bromo-5-nitro-1,3-dioxane, tris (hydroxymethyl) nitromethane, 1-nitropropane, 2-nitropropane, 2-bromo-2-nitropropane-1,3-diol, 3-nitrobenzenesulfonic acid, sodium salt, 5-nitrobenzene-1,3-dicarboxylic acid, hydrolysable nitrophenyl esters, and combinations of one or more of the foregoing.

5. The method according to claim 1, wherein the water-soluble nitro compound comprises an inorganic nitro compound selected from the group consisting of sodium nitrite, potassium nitrite, calcium nitrite, cobalt potassium nitrite, any water-soluble salt of nitrous acid, and combinations of one or more of the foregoing.

6. The method according to claim 1, wherein the pH buffer maintains the near neutral pH pickle composition at a pH within the range of about 4.9 to about 6.0.

7. The method according to claim 1, wherein the polarizing agent comprises a carboxylate selected from the group consisting of acetate, citrate, succinate, ascorbate, lactate, gluconate, glucoheptonate, glycolate, salicylate, and combinations of one or more of the foregoing.

8. The method according to claim 1, wherein the polarizing agent comprises a phosphonate selected from the group consisting of sodium phosphonate, sodium poly(isopropenylphosphonate), 2-ethylhexyl 2-ethylhexylphosphonate, octane phosphonic acid, sodium poly(isopropenylphosphonate), tetrasodium editronate, sodium amino tri (methylene phosphonic acid), benzenephosphonic acid, 1-hydroxyethylidene-1,1-diphosphonic acid, cocoamino-dimethylene phosphonic acid, diamino tetramethyl phosphonic acid, pentasodium diethylene triamine pentamethylene phosphonate, aminotrimethylene phosphonic acid, disodium azacycloheptane diphosphonate, and combinations of one or more of the foregoing.

9. The method according to claim 1, wherein the step of contacting the surface with the near neutral pH pickle composition is performed by immersing the surface in the near neutral pH pickle composition for a period of time.

10. The method according to claim 1, wherein the near neutral pH pickle composition is maintained at a temperature between about 70 to about 180° F.

11. The method according to claim 1, wherein the near neutral pH pickle composition is maintained at room temperature.

12. The method according to claim 1, wherein the metal oxides comprise at least one of iron oxides and heat treated scale.

13. The method according to claim 1, wherein the metal oxides comprise iron and an iron removal rate is at least about 4 μm/hour.

14. The method according to claim 4, wherein the nitro organic compound does not contain an amine functional group.

15. The method according to claim 6, wherein the pH buffer maintains the near neutral pH pickle composition at a pH within the range of about 5.0 to about 5.5.

16. The method according to claim 7, wherein the carboxylate also functions as the pH buffer and the at least one metal complexing agent.

17. The method according to claim 8, wherein a molar ratio of the phosphonate to the nitro compound is in the range of about 1:1 to about 10:1.

18. The method according to claim 9, where the period of time comprises 1 minute to 24 hours.

19. The method according to claim 10, wherein the near neutral pH pickle composition is maintained at a temperature between about 120 to about 140° F.

20. The method according to claim 13, wherein the iron removal rate is at least about 5 μm/hour.

21. The method according to claim 17, wherein the molar ratio of the phosphonate to the nitro compound is in the range of about 1:1 to about 5:1.

22. The method according to claim 20, wherein the iron removal rate is at least about 7 μm/hour.

23. The method according to claim 22, wherein the iron removal rate is at least about 20 μm/hour.

* * * * *